United States Patent [19]

Hermkens et al.

[11] Patent Number: 4,660,824

[45] Date of Patent: Apr. 28, 1987

[54] DEVICE FOR COLLATING SHEETS

[75] Inventors: Gerardus A. J. Hermkens, EW Herten; Augustinus W. M. Lambregts, JL Venlo, both of Netherlands

[73] Assignee: Oce-Nederland B.V., Venlo, Netherlands

[21] Appl. No.: 780,327

[22] Filed: Sep. 26, 1985

[30] Foreign Application Priority Data

Sep. 27, 1984 [NL] Netherlands ..... 8402941

[51] Int. Cl.[4] ..... B65H 31/02

[52] U.S. Cl. ..... 271/208; 271/182

[58] Field of Search ..... 271/208, 209, 182

[56] References Cited

U.S. PATENT DOCUMENTS 3,957,264 5/1976 Bach et al. ..... 271/182 X 4,501,418 2/1985 Ariga et al. ..... 271/208 X

FOREIGN PATENT DOCUMENTS 0024712 3/1981 European Pat. Off. ..... 271/208

0031839 2/1983 Japan ..... 271/208

OTHER PUBLICATIONS

Bach et al., "Collator Bin", IBM Tech. Disc. Bull., vol. 19, No. 1 (Jun. 1976) pp. 12–13.

*Primary Examiner*—Duane A. Reger

*Assistant Examiner*—Matthew C. Graham

*Attorney, Agent, or Firm*—Reed Smith Shaw & McClay

[57] ABSTRACT

In a device for collating sheets of paper having at least one receiving surface made from electrically insulating material, a set of rolls for feeding a sheet from one side of the receiving surface and depositing it thereon and an improved charge remover for removing electrical charges from a deposited sheet comprising at least one conductor connected to earth potential which is disposed on the side of the insulated receiving surface remote from the side where the sheet enters and which forms an abutment with which the leading edge of each sheet comes into contact when it is being deposited on the insulated receiving surface, thereby removing electrical charges from the entire sheet.

2 Claims, 1 Drawing Figure

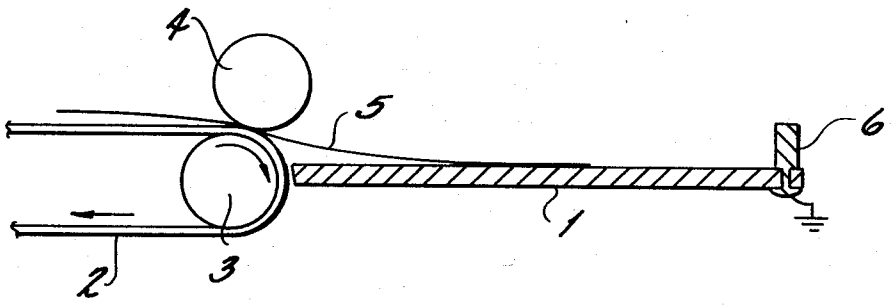
4
5
6
3
1
2

DEVICE FOR COLLATING SHEETS

BACKGROUND OF THE INVENTION

1. Field of the Invention

The present invention relates to the field of collators and specifically to devices for collating sheets of paper. More particularly, the invention relates to a collator having an improved mechanism for removing electrical charges from the sheets as they are collated.

2. Description of the Prior Art

It is generally known that when sheets of paper are handled, such as when making copies in an electrophotographic copying machine, the sheets often become electrically charged. Such an electrical charge may make transportation of the sheets in the copier more difficult. Also, when the sheets are collated in a pile, the electrical charge accumulated in the pile may be large enough that a person touching the pile receives an electric shock. This undesirable phenomenon can be obviated if the surface on which the sheets are collated is made from an electrically insulating material and a means is used to discharge the deposited sheets as much as possible.

A typical collating device is disclosed in U.S. Pat. No. 3,957,264. This device has an electrically insulating receiving surface which is curved in one direction and which has upright edges. It also has a brush extending transversely from the direction of sheet transport, with conductive bristles above the receiving surface for removing electrical charges. The electric field between a charged sheet on the receiving surface and the sharp ends of the bristles is supposed to ionize the air above the sheet, creating an atmosphere in which the sheet charge is reduced.

A major disadvantage of the device described in U.S. Pat. No. 3,957,264, however, is that the brush electrode is situated relatively far away from the receiving surface and the charged sheets lying thereon, so that it will have very little effect on reducing sheet charge when only a few sheets are collated. In such a case, therefore, strong residual charges will remain on the few collated sheets.

Japanese Patent Abstract 57-27272 of Fuji Xerox KK relates to a discharge tray. The disclosure, however, teaches that a substantial portion of the discharge tray is made of conductive material instead of insulating material. Even with this substantial area of conductive material, there is no way to assure that any sheet other than the first sheet will be discharged. Thus, this device will have very little effect on reducing sheet charge, unless the other sheets, by chance, happen to come into contact with the conductive material.

Japanese Patent Abstract 56-116048 of Cannon KK relates to a storage tray for paper, not to a collator. The discharge problems associated with feeding a prestacked pile of paper and those associated with collating individual sheets are different. For example, the metal retaining members of a storage tray may directly abut and contact the prestacked papers. This is not possible in a collator because the copying machine cannot expel copies with enough precision to permit the effective discharge of the sheets through rubbing with metal sides. Thus, there exists a need for an improved method of discharging residual charge in a collator which assures that each sheet will be discharged.

SUMMARY OF THE INVENTION

Generally, the present invention provides an improved means for removing sheet charge in a collator. The present invention provides a device for collating sheets of paper, comprising at least one receiving surface made from electrically insulating material, a means to feed a sheet from one side and deposit it on the receiving surface, and a means for removing electrical charges from the deposited sheet, wherein the means for removing electrical charges comprises at least one conductor connected to earth potential, said conductor being disposed on the side remote from the entry side of the receiving surface and forming an abutment with which the leading edge of the sheet comes into contact when it is being deposited.

In a collating device utilizing the present invention, an electric field will exist between the conductor and the thin leading edge of each sheet that is conveyed over the receiving surface. As the leading edge of the sheet approaches the conductor, the strength of the electric field increases rapidly to its breakdown value thereupon ionizing the air near the leading edge. Under these conditions, the charged sheet will be almost entirely discharged with the result that any accumulation of residual charges in a collated pile of sheets will be minimal.

BRIEF DESCRIPTION OF THE DRAWING

FIG. 1 is a receiving surface of a collator embodying the present invention.

DESCRIPTION OF THE PREFERRED EMBODIMENTS

The present invention particularly provides an improved means for removing the electrical charge from sheets of paper in a collator as shown in FIG. 1. Receiving surface 1 is made from an insulating material. Conveyor belt 2 is trained about roller 3, with pressing roller 4 resting on the belt. By means of belt 2 and rollers 3 and 4, sheets of paper 5 can be fed from one side onto receiving surface 1. The conveying speed is such that each sheet slides over the receiving surface and comes to rest against abutment 6. Abutment 6 is made from an electrically conductive material, such as metal, and is connected to earth potential.

If a sheet 5 becomes statically charged in any manner, such as could occur due to slippage on belt 2 or as a consequence of the pressure between rollers 3 and 4, the charge present in the sheet will shift through it towards the sheet's leading edge as the leading edge approaches abutment 6. This shift in charge is possible because the sheet is naturally somewhat conductive. The strength of the electric field between the leading edge of the sheet and abutment 6 will, thus, rapidly increase and reach the breakdown limit known from the so-called Paschen curve. The air near the leading edge will become ionized under these conditions, and as a result, the charge on the sheet will almost completely leak away.

Abutment 6 can be made in various ways. It may be a plate, extending perpendicular to the direction of sheet transport, over the entire width of receiving surface 1 and riveted or screwed thereto by means of projections. Instead of a plate, it is possible to use a plurality of conducting abutments along the edge of receiving surface 1, disposed in a spaced relationship adjacent to one another. Alternatively, receiving surface 1 may be made with an upright edge of insulating material, the side which faces the receiving surface being provided with conductive wires, strips, or surfaces.

While presently preferred embodiments of the invention have been described in particularity, the invention may be otherwise embodied within the scope of the appended claim.

What is claimed is:

1. In a device for collating sheets of paper, having at least one receiving surface made from electrically insulating material, a means to feed a sheet from one side of the receiving surface and deposit it thereon, and a means for removing electrical charges from the deposited sheet, the improvement comprising at least one conductor connected to earth potential and being disposed on the side of the insulated receiving surface remote from the side where the sheet enters to form an abutment with which the leading edge of the sheet containing concentrated electrical charges comes into contact when it is being deposited on the insulated receiving surface, thereby removing the electrical charges from the entire sheet.

2. The device as described in claim 1 wherein the conductor comprises a plurality of conducting abutments along the edge of the insulated receiving surface disposed in a spaced relationship adjacent to one another.

* * * * *